United States Patent [19]

Dodd

[11] 4,106,122

[45] Aug. 15, 1978

[54] HALTERED COVER GARMENT FOR NURSING MOTHERS

[76] Inventor: Laura M. Dodd, 815 Captain Frank Rd., New Albany, Ind. 47150

[21] Appl. No.: 815,522

[22] Filed: Jul. 14, 1977

[51] Int. Cl.[2] ..... A41D 1/20

[52] U.S. Cl. ..... 2/104; 2/48

[58] Field of Search ..... 2/104, 48

[56] References Cited

U.S. PATENT DOCUMENTS

| | | | |
|---|---|---|---|
| 660,843 | 10/1900 | Coyle | 2/104 X |
| 1,013,778 | 1/1912 | Jacoby | 2/104 |
| 2,620,476 | 12/1952 | Kelsall | 2/48 X |
| 2,782,419 | 2/1957 | Swartz | 2/48 |

*Primary Examiner*—Doris L. Troutman
*Attorney, Agent, or Firm*—Maurice L. Miller, Jr.

[57] ABSTRACT

An apron having a neck halter and extending downward across the chest of the wearer a distance at least sufficient to cover her breasts and containing a pair of flaps which may be formed from flattened pleats extending across the breasts, which flaps overlie a pair of openings through said apron in the area of the breasts.

An additional feature is a pair of back straps depending from each side of the apron for making the garment suitably secure for wearing over the top of shirts, blouses, sweaters and the like.

14 Claims, 3 Drawing Figures

HALTERED COVER GARMENT FOR NURSING MOTHERS

BACKGROUND OF THE INVENTION

This invention relates generally to clothing for nursing mothers to facilitate convenient nursing of their babies.

Such clothing has long been known in the prior art such as, for example, the nursing waist disclosed in U.S. Pat. Nos. 1,013,778 issued to J. Jacoby on Jan. 2, 1912, the nursing gown disclosed in 778,014 issued to R. T. Coyle on Dec. 20, 1904, and the nursing dress disclosed in 232,246 and issued to M. Duenckel on Sept. 14, 1880. While these prior art articles of clothing are all intended to facilitate nursing, they are each a primary article of clothing in and of themselves. They are not intended as supplemental articles of clothing to be worn over or under a primary article of clothing and, indeed, could not readily be worn in such a way.

Furthermore, because these prior art garments are primary articles of clothing, they do not permit the nursing mother a wide choice in the selection of her wearing apparel. For example, these garments can not be worn as supplemental articles of clothing along with sweaters, blouses, shirts, jackets, vests or other primary and conventional garments which the nursing mother might choose to wear from time to time. In other words, she would be essentially restricted to the wearing of these specialized prior art garments throughout her period of nursing and could not enjoy the flexibility of dressing in a variety of conventional clothing as can other women not involved in the nursing of infants.

My invention substantially overcomes these and other prior art difficulties.

SUMMARY OF THE INVENTION

Briefly, it is an object of the present invention to provide a haltered cover garment for nursing mothers which includes an bib having an upper portion defining a neck halter and a lower portion extending from the neck halter downward across the chest of the wearer a distance at least sufficient to cover her breasts. The lower portion of the apron contains a pair of flaps extending across the breasts and overlying a pair of openings formed through the bib in the areas of each breast.

This and other objects of the subject invention will become apparent to those skilled in the art from the following detailed description and attached drawings upon which, by way of example, only the preferred embodiments of the subject invention are illustrated.

DESCRIPTION OF THE PREFERRED EMBODIMENTS

Figure 1:
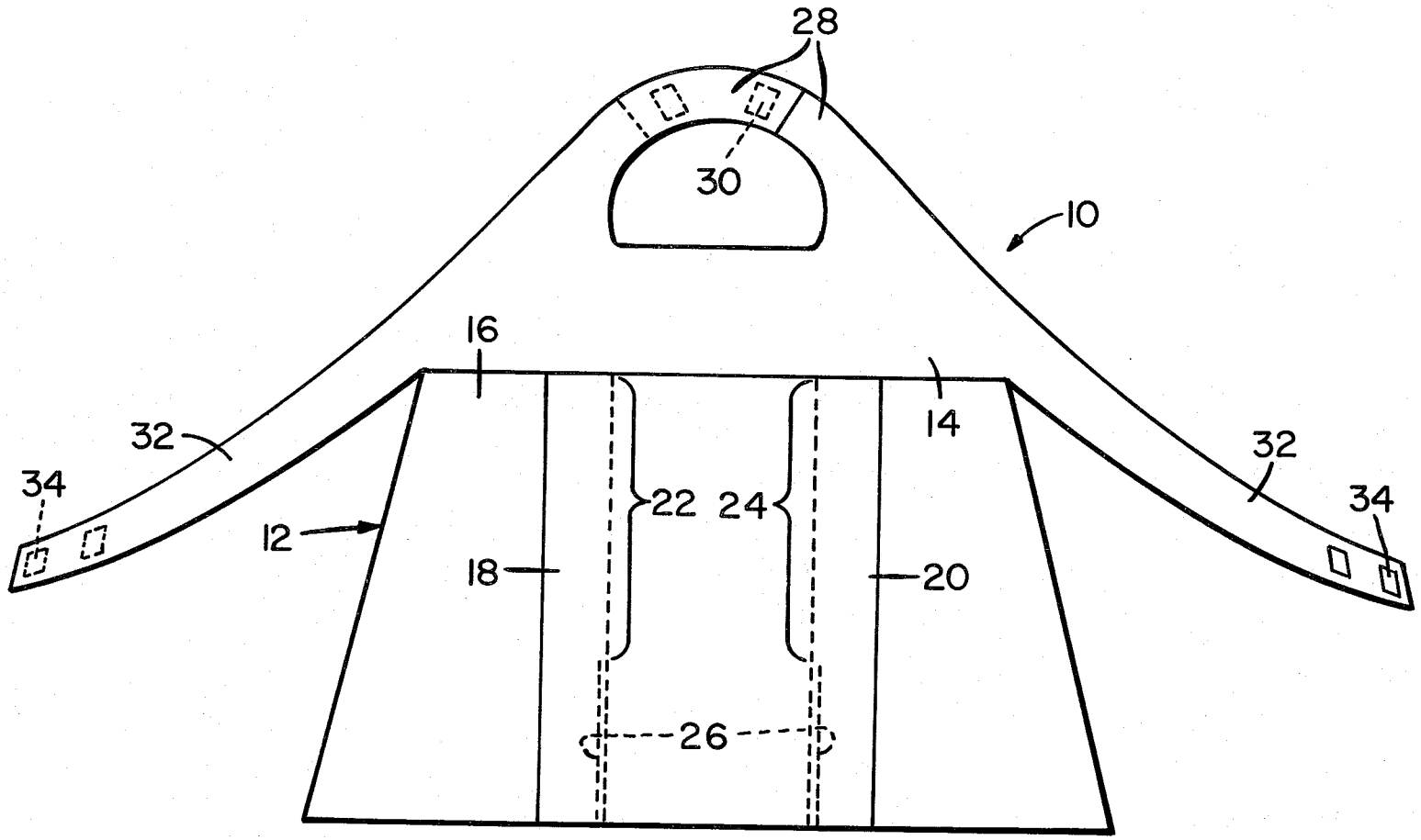
FIG. 1 shows an elevation view of the front of a haltered cover garment for nursing mothers as the same would lie flat upon a table, thus illustrating one preferred embodiment of the subject invention.

Referring now to FIG. 1 there is shown, in one preferred embodiment of the instant invention, a haltered cover garment 10 for a nursing mother which may be constructed of any suitable fabric such as cotton, wool, or other natural or synthetic material used in articles of clothing.

Figure 2:
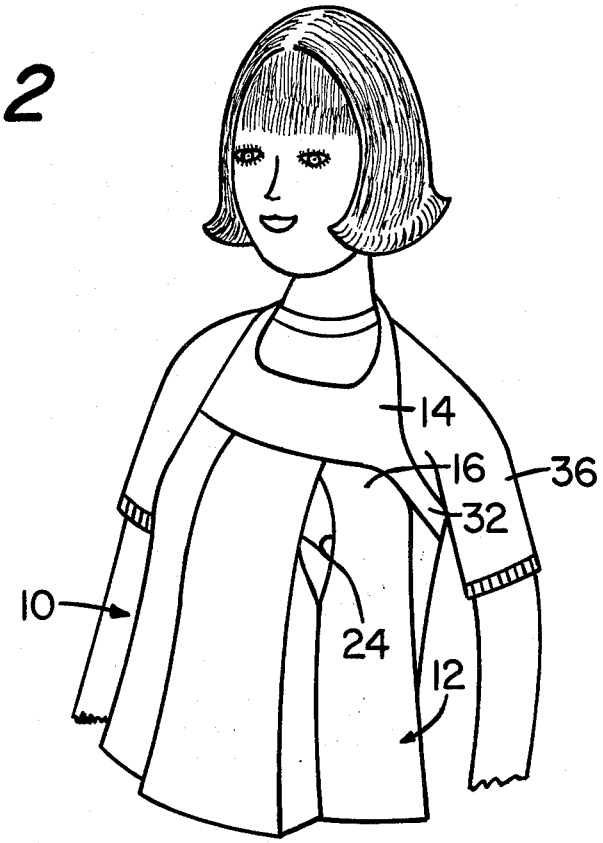
FIG. 2 shows the garment of FIG. 1 as it may be worn by a nursing mother over a primary article of clothing such as a sweater, thus illustrating one application of the subject invention.
Figure 3:
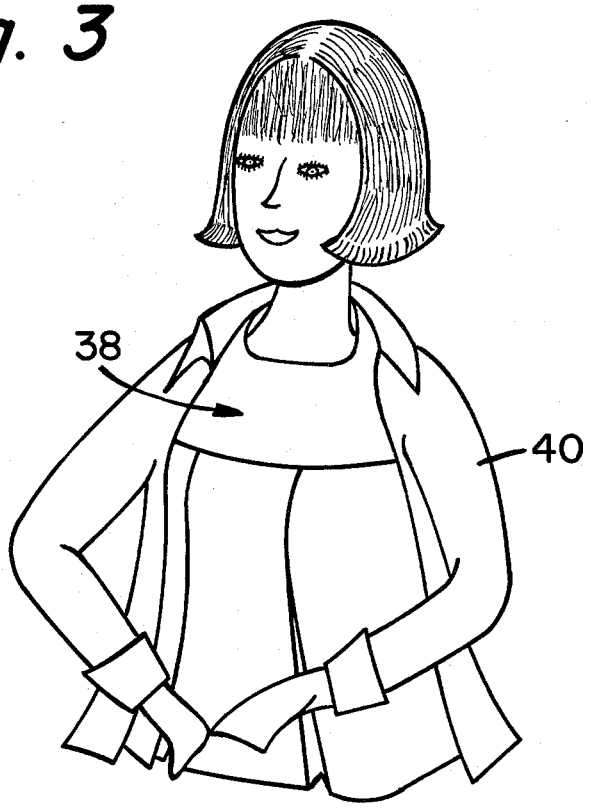
FIG. 3 shows a cover garment for nursing mothers as the same may be worn under a primary article of clothing such as a blouse or jacket, thus illustrating another application of the subject invention.

The garment 10 of the subject example includes a sleeveless apron or bib 12 having an upper portion 14 defining a neck encircling halter, and a lower portion 16 which extends from the upper portion 14 downward across the chest of the wearer to cover her breasts and, preferably, to the level of the waist. As used herein the term "apron" is employed interchangably with the term "bib" and shall be understood as referring to a chest covering garment, although the garment (apron or bib) as referred to herein may, in addition, extend below the chest area as, for example, to or below the region of the waist such as is illustrated in FIGS. 2–3. A pair of flaps 18, 20 are formed on the lower portion 16 and aligned so as to extend across the breasts of the wearer, preferably, vertically. The flaps 18, 20 lie flat against the material of the lower portion 16 so as to conceal a pair of slits or openings 22, 24, respectively, formed through the material of the apron 12 opposite the area of each breast. The openings 22, 24 of the present example extend from the top of the lower portion 16 about two-thirds of the distance to the bottom of the apron 12 in the waist region. The flaps 18 and 20 may be stitched to the lower portion 16 along the lower one-third of their vertical length as indicated by the dashed lines at 26 and along the top of the lower portion 16. Thus the flaps 18, 20 are openable toward the right and left sides of the wearer, respectively. In other words, each flap opens toward the nearest side of the wearer to permit external access to the openings 22 and 24 for permitting nursing.

Since the slits or openings 22, 24 are recessed behind the flaps 18 and 20 as viewed from the front of the garment, they are effectively concealed from view. Moreover, the flaps 18, 20 aid in concealing the breasts of the wearer to permit her to nurse her baby in public places without undue exposure. In the instant example, the neck halter formed in the upper portion 14 may be partially defined by two neck straps 28 which interconnect together in any suitable and well known manner upon the back of the wearer's neck. I recommend sewing at least a pair of suitably adhesive strips or patches 30 to opposing overlappable end portions near the free ends of the neck straps 28 so that the straps 28 may be conveniently connected and disconnected by the wearer although hooks, buttons, snaps or other suitable fasteners could be substituted therefor.

An additional feature of the garment of my invention as shown in the present example is a pair of back straps 32 which depend from the apron 12, preferably from the upper portion 14 thereof and which are suitably adapted to extend around the sides of the wearer under her arms so interconnect upon the midline of her back. While any suitable and well known fasteners may be employed to interconnect the back straps 32, I prefer to use at least a pair of adhesive strips or patches 34 of material attached to opposing overlappable end portions of the straps 32.

While the back straps 32 are optional features of the garment 10, they provide additional security of fit so that the garment 10 can be worn as an attractive, supplemental article of clothing by the nursing mother over her preference of primary articles of clothing such as, for example, a sweater 36 of the type illustrated in FIG. 2. In the view shown in FIG. 2, the exposure of the slit 24 recessed behind the left side flap formed on the lower portion 16 is exaggerated for purposes of illustration.

Thus the garment of my invention, containing the back straps as an additional feature, provides an attractive cover garment to be worn over a wide variety of other articles of clothing of the mother's choice such as the sweater 36 exemplified in FIG. 2 or blouses, shirts and so forth. It should also be noted that the lower portion 16 of the garment of FIG. 1 may be pleated to form the openable flaps 18 and 20. In such a case, the openings 22 and 24 are preferably formed above the stitches 26 at the edge of the secured side of the pleats. The lower portion 16 may be constructed of three pieces of material consisting of two side pieces and a central rectangular piece overlapping the inside edges of the side pieces or may be formed of a single piece of material and pleated in the manner illustrated to form the flaps 18 and 20. Consequently, by means of my invention, nursing mothers may obtain relative freedom of dress and yet have the privacy they desire. The sweater 36 of FIG. 2, for example, can readily be lifted up to expose the breasts behind the apron of the nursing garment.

Referring now to FIG. 3, it will be seen that a halter cover garment 38 for nursing mothers, made in accordance with the principals of my invention, may be worn under a variety of primary outer wear such as, for example, a blouse or jacket 40. In this latter example, the lower portion of the garment 40 may be buttoned or zipped across the front so that the garment 38 is concealed except when in use. Since the garment 38 of this example is worn as an under garment, backstraps to provide additional security of fit, such as the backstraps 32 of the previous example, need not be employed and sufficient security of fit can be obtained by use of a neck halter such as the halter 28 of the previous example. Accordingly, the garment of my invention is readily adaptable for use by nursing mothers as an attractive and functional outer garment, supplementing other primary articles of clothing, as well as an under garment to be worn with a wide choice of clothing. For the purposes of the present invention, those skilled in the art will recognize that the halter 28 of FIG. 1 may be fashioned in various manners. Also, a neck halter might be formed by the use of ornamental chains, straps, cords, and attached to the garment rather than being fashioned as an integral part thereof.

Although the subject invention has been described with respect to specific details of certain preferred embodiments thereof, it is not intended that such details limit the subject invention except insofar as is set forth in the following claims.

I claim:

1. A haltered cover garment for nursing mothers comprising a bib having an upper portion defining a neck halter, and a lower portion extending from said neck halter downward across the chest of the wearer a distance at least sufficient to cover her breasts, said lower portion containing a pair of flaps extending across the breasts and overlying a pair of openings formed through said bib in the areas of each breast, said lower portion further comprising a pair of side pieces of material, the outside edges of which terminate along the sides of the wearer, and a central rectangular piece of material, the sides of which overlap the inside edges of said side pieces to form said flaps.

2. The garment of claim 1 wherein said lower portion further comprises a pair of flattened pleats extending across the area of the breasts to form said flaps.

3. The garment of claim 1 further comprising a pair of back straps attached to opposite sides of said bib for extending around the sides of the wearer and interconnecting upon her back.

4. The garment of claim 1 wherein each of said flaps is formed so as to open toward the nearest side of the wearer to expose each slit to said side.

5. The garment of claim 1 wherein said neck halter further comprises a pair of neck straps for encircling and interconnecting across the back of the neck of the wearer.

6. The garment of claim 2 wherein each of said pleats extends vertically at least partially across said lower portion.

7. The garment of claim 3 further comprising at least a pair of adhesive strips of material attached to opposing overlappable end portions of the free ends of said back straps for selectively interconnecting said back straps together.

8. The garment of claim 3 wherein said back straps are attached to said upper portion.

9. The garment of claim 5 further comprising at least a pair of adhesive strips of material attached to opposing overlappable end portions of the free ends of said neck straps for selectively interconnecting said neck straps together.

10. The garment of claim 1 wherein said bib extends downward from the neck of the wearer to the area of her waist.

11. The garment of claim 1 wherein said apron is sleeveless.

12. The garment of claim 1 wherein said lower portion terminates in the proximity of the waist.

13. The garment of claim 1 wherein said lower portion terminates in the proximity of the waist, said garment being a supplemental article of clothing for wearing under or over a primary article of clothing.

14. A haltered cover garment for nursing mothers comprising a bib having an upper portion defining a neck halter, and a lower portion extending from said neck halter downward across the chest of the wearer a distance at least sufficient to cover her breasts, said lower portion containing a pair of flaps extending across the breasts and overlying a pair of openings formed through said bib in the areas of each breast, said lower portion being a single piece of material and further comprising a pair of side portions, the outside edges of which terminate along the sides of the wearer, and a central rectangular portion, the sides of which overlap the inside edges of said side portions to form said flaps.

* * * * *